US006830367B2

(12) United States Patent
Peterson et al.

(10) Patent No.: US 6,830,367 B2
(45) Date of Patent: Dec. 14, 2004

(54) DIALYSIS SOLUTION SYSTEM AND MIXING TANK

(75) Inventors: Roger A. Peterson, Maple Grove, MN (US); John J. Matta, Shoreview, MN (US); Bert Walter, Mendota Heights, MN (US)

(73) Assignee: Minntech Corporation, Minneapolis, MN (US)

( * ) Notice: Subject to any disclaimer, the term of this patent is extended or adjusted under 35 U.S.C. 154(b) by 161 days.

(21) Appl. No.: 10/279,527

(22) Filed: Oct. 24, 2002

(65) Prior Publication Data

US 2003/0043688 A1 Mar. 6, 2003

Related U.S. Application Data

(63) Continuation-in-part of application No. 29/144,403, filed on Jul. 2, 2001, now abandoned.

(51) Int. Cl.[7] ..... B01F 5/04

(52) U.S. Cl. ..... 366/137; 366/141; 366/163.2; 366/167.1

(58) Field of Search ..... 366/136–137, 366/165.1, 165.2, 167.1, 175.2, 159.1, 162.1, 141, 173.1, 173.2, 174.1, 163.2

(56) References Cited

U.S. PATENT DOCUMENTS

| | | | | | |
|---|---|---|---|---|---|
| 626,950 | A | * | 6/1899 | Wheelwright | 366/134 |
| 1,580,476 | A | * | 4/1926 | Fassio | 68/184 |
| 1,991,148 | A | * | 2/1935 | Gephart | 366/165.1 |
| D162,903 | S | * | 4/1951 | Trautvetter | D7/510 |
| 2,603,460 | A | * | 7/1952 | Kalinske | 366/173.2 |
| 2,795,403 | A | * | 6/1957 | Mead | 366/107 |
| 2,906,607 | A | * | 9/1959 | Jamison | 422/278 |
| 2,997,373 | A | * | 8/1961 | Stephens | 422/282 |
| 3,271,304 | A | * | 9/1966 | Cox et al. | 210/621 |
| 3,425,669 | A | * | 2/1969 | Gaddis | 366/153.1 |
| 3,586,294 | A | * | 6/1971 | Strong | 366/163.2 |
| 4,325,642 | A | * | 4/1982 | Kratky et al. | 366/137 |
| D269,148 | S | * | 5/1983 | Trkla et al. | D7/511 |
| D270,961 | S | * | 10/1983 | Hawkins et al. | D32/53 |
| 4,496,244 | A | * | 1/1985 | Ludwig | 366/136 |
| 4,531,652 | A | | 7/1985 | Hara | |
| 4,660,988 | A | * | 4/1987 | Hara et al. | 366/137 |
| 4,664,891 | A | | 5/1987 | Cosentino et al. | |
| D291,022 | S | * | 7/1987 | Erickson | D34/39 |
| 4,734,198 | A | | 3/1988 | Harm et al. | |
| 4,812,045 | A | * | 3/1989 | Rivers | 366/107 |
| D325,344 | S | * | 4/1992 | Scholle | D34/39 X |
| D328,507 | S | * | 8/1992 | Campbell | D32/53 |
| 5,253,937 | A | * | 10/1993 | Scheimann et al. | 366/136 |
| D348,130 | S | * | 6/1994 | Miller | D32/53 |
| D374,321 | S | * | 10/1996 | Mandell et al. | D32/53 |
| 5,609,417 | A | * | 3/1997 | Otte | 366/137 |
| 5,690,821 | A | | 11/1997 | Kenley et al. | |
| D395,531 | S | * | 6/1998 | Mandell et al. | D32/53 |
| 5,769,536 | A | * | 6/1998 | Kotylak | 366/136 |
| 5,782,376 | A | * | 7/1998 | Brauner et al. | 220/669 |
| D405,931 | S | * | 2/1999 | Palmer | D34/39 |
| D422,609 | S | * | 4/2000 | Fong et al. | D34/39 |
| D422,770 | S | * | 4/2000 | Schmitt | D34/39 X |
| D426,044 | S | * | 5/2000 | Cramer et al. | D34/39 |
| 6,065,860 | A | * | 5/2000 | Fuchsbichler | 366/136 |
| 6,109,778 | A | * | 8/2000 | Wilmer | 366/137 |
| 6,186,657 | B1 | * | 2/2001 | Fuchsbichler | 366/165.4 |
| 6,210,803 | B1 | | 4/2001 | Backhaus et al. | |
| 6,251,437 | B1 | | 6/2001 | Fischbach | |
| 6,395,180 | B2 | | 5/2002 | Chioini et al. | |
| 6,592,246 | B2 | * | 7/2003 | Maree | 366/132 |
| 2002/0105855 | A1 | | 8/2002 | Behnke et al. | |
| 2003/0043688 | A1 | * | 3/2003 | Peterson et al. | 366/137 |

FOREIGN PATENT DOCUMENTS

| | | | |
|---|---|---|---|
| EP | 0225237 | * | 6/1987 |

* cited by examiner

*Primary Examiner*—Charles E. Cooley
(74) *Attorney, Agent, or Firm*—Minntech Corporation

(57) ABSTRACT

A low-profile tank and system for mixing dry chemicals with water to form a concentrated hemodialysis solution, the tank having a fluid supply nozzle projecting into a cylindrical side wall of the tank, and a drain connection at an apex of a conical bottom wall of the tank. A cavity having a ramp-like bottom wall extends from the cylindrical side wall of the tank. A venturi eductor provides for transfer of dry chemicals to the tank using compressed air to aspirate the chemicals and deliver them to the tank. A plurality of load cells may be used to measure the weight of the tank and contents. Manual transfer of dry chemicals to the tank is facilitated by the low profile of the tank. A tapered shipping container is provided for nesting when empty.

40 Claims, 20 Drawing Sheets

DIALYSIS SOLUTION SYSTEM AND MIXING TANK

CROSS REFERENCE TO RELATED APPLICATION

This application is a continuation-in-part U.S. Ser. No. 29/144,403, filed Jul. 2, 2001, with the title LOW PROFILE MIXING TANK now abandoned.

BACKGROUND OF THE INVENTION

In the past, various efforts were made to provide a system for preparing a hemodialysis solution from dry chemicals and water on a large scale batch basis. Some systems transferred the packaged dry chemicals into a mixing vessel by creating a water slurry from the dry chemicals and aspirating the slurry into a mixing tank where it was dissolved with additional water to form a solution with a desired concentration of chemicals therein. Other systems depended on the user manually adding the dry chemicals to the mixing tank. The ability to rapidly transfer and dissolve the dry chemicals has continued to be an obstacle in both types of systems in that the dry chemicals settle to the bottom of the mixing tank, resulting in prolonged dissolution periods with conventional agitation of the contents of the mixing tank. The present invention provides an improved transfer mechanism to deliver the dry chemicals to a mixing tank, and further provides a mixing tank and recirculation apparatus that create high turbulence at the bottom of the tank that accelerates formation of the desired solution and promotes uniformity in the chemical concentration of the solution. Examples of the chemicals to be mixed in the mixing tank of the present invention are the Renasol® and Centrisol® acid concentrates or solutions of bicarbonate for hemodialysis concentrates available from the assignee of the present invention. Existing designs for large tanks that mix solutions suffer from several ergonomic shortcomings. These include the inability to fit through a standard door, excessive tank height that makes it difficult to lift powder bags for pouring, and inadequate mixing of these very large volumes, including the creation of "dead spots" where there is not adequate circulation.

The present invention includes a mixing tank for solutions. It has a capacity of up to 110 gallons or more and also has mounting locations for a control panel built into the design that imparts a mixing feature to the tank. The unique shape of the tank includes a forward projecting area with a downward sloping floor which bestows enhanced circulation of the solution. The design increases the volume of the mixer while maintaining a waist height profile. In addition, the narrow width also allows it to fit through a standard door. The location for the addition of solids to be mixed into solution is ergonomically designed to be close to the front of the tank, and there is a shelf on the top of the tank, so that bags of solids can rest on it while being poured into the tank.

DETAILED DESCRIPTION OF THE INVENTION

Figure 1:
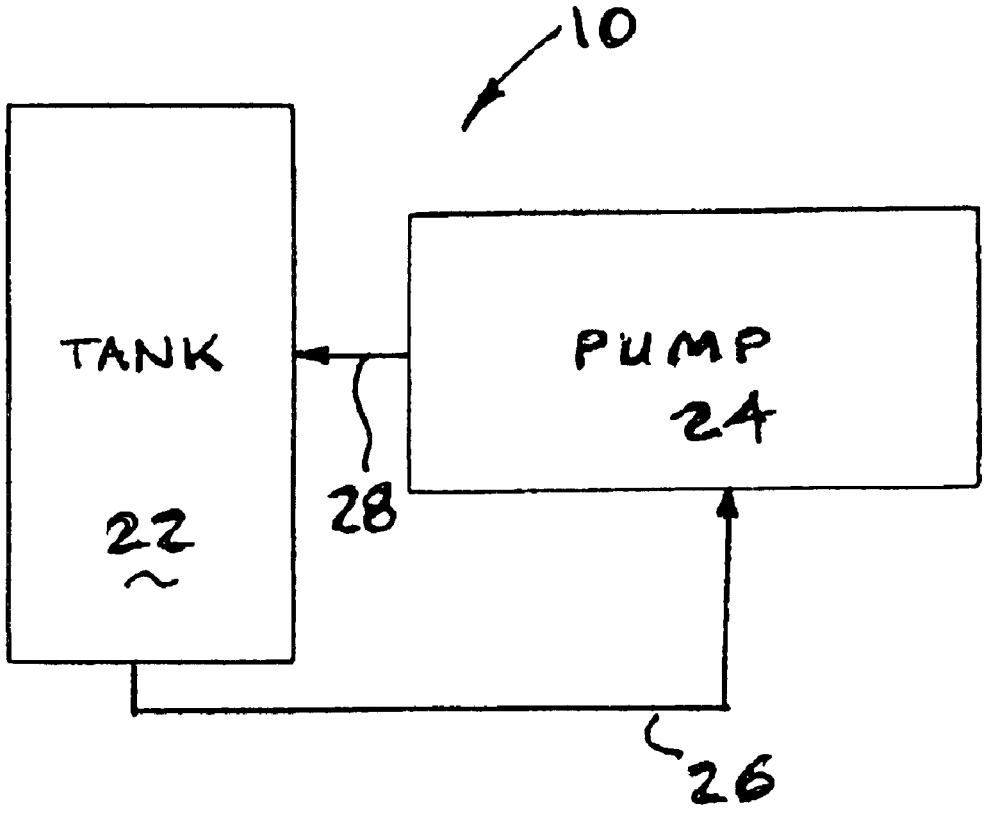
FIG. 1 is a block diagram of the system of the present invention.
Figure 2:
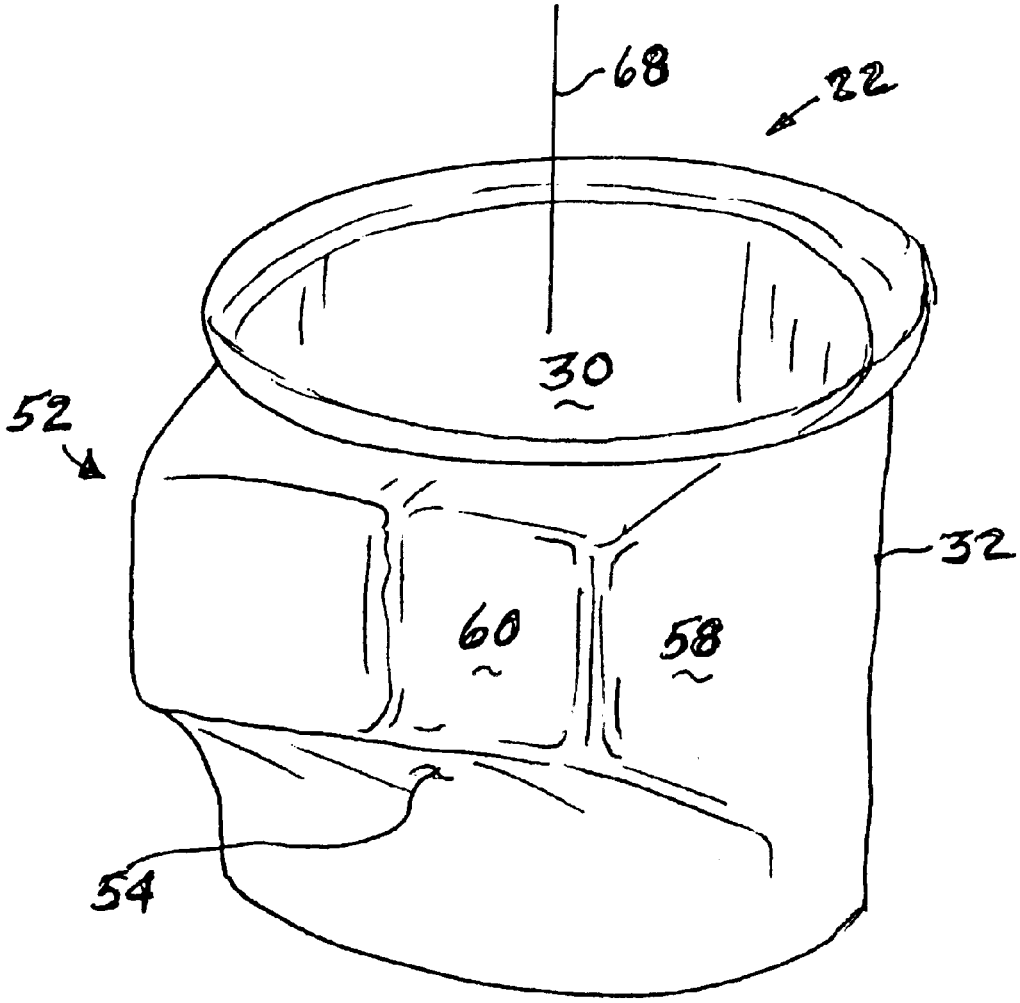
FIG. 2 is a perspective view of a mixing tank useful in the practice of the present invention.

Referring now to the Figures, and most particularly to FIG. 1, a block diagram 10 of the present invention may be seen. System 20 includes a mixing tank 22 and a pump 24, connected to the mixing tank via a tank drain line 26 and a fluid return line 28. It is to be understood that, in operation, mixing tank 22 is preferably charged with a predetermined amount of deionized, AAMI (Association for the Advancement of Medical Instrumentation, 1110 N. Glebe Road, Suite 220, Arlington, Va. 22201-4795) standard hemodialysis quality water to make up a known quantity of dialysis solution by adding dry chemicals appropriate to form the dialysis solution in the concentration desired. In one embodiment of the present invention, it is contemplated to manually add the dry chemicals to the water, by pouring the dry chemicals into the mixing tank containing the water. To that end, the mixing tank 22 of the present invention is sized to have a height limited to about average human waist height to reduce the effort needed to manually transfer the chemicals into the tank. In another embodiment, dry chemicals may be added to the water using an air eductor system which is described infra. In this embodiment, the dry chemicals are extracted from one or more containers (not shown in FIG. 1, but preferably located adjacent the mixing tank). During and after the dry chemicals are added, the fluid (thus including some and eventually all of the quantity of added chemicals) is recirculated using the pump 24 and fluid lines 26 and 28 to achieve an evenly distributed, fully solubilized hemodialysis solution.

Referring now to FIGS. 2 through 5, certain details of the mixing tank 22 may be seen. Tank 22 has an upright mixing chamber 30 having a right circular cylinder sidewall 32 extending up from a bottom wall 34, which is preferably conical. As used herein, cylinder means a volume defined by a closed plane curve forming a base with a closed plane curve (which is preferably, but not necessarily identical) parallel to it. Cylinder also means the surface defined by a generator, which is a line segment from a point on one curve to a corresponding point on the other curve. Similarly, as used herein, cone and conical refer to a volume defined by a closed plane curve forming the base and a point (the vertex) outside the plane. A drain connection 36 is formed in the lowermost region of the bottom wall (which preferably is at the vertex of the bottom wall 34 when the wall is conical). The drain connection is fluidly connected to tank drain line 26. A fluid supply nozzle 38 projects through cylinder sidewall 32 generally along a diameter 44 of the circular cross section of the tank 22 and has a fluid outlet 40 directed at a horizontal angle 42 away from the diameter 44 of the cylinder sidewall 32, as may be seen in FIG. 3*a*. Both the drain connection 36 and the fluid supply nozzle 38 preferably have a 1 inch inside diameter. As may be seen in most detail in FIGS. 4*a*, and 5, fluid outlet 40 is directed at a vertical angle 48 with respect to a horizontal line 47. Angle 42 is preferably 20 degrees and angle 48 is preferably 23.8 degrees. Each of angles 42 and 48 may be selected to be within the range of 10 to 60 degrees. The fluid supply nozzle preferably projects in from the inner surface of the cylindrical sidewall 32 a distance 46 of 3.74 inches. The length of the outlet 40 extending from the fluid supply nozzle is preferably 2.2 inches. The fluid supply nozzle is preferably positioned a distance 51 of 1.83 inches above the junction of the sidewall 32 and the bottom wall 34. Similarly, the nozzle 38 is positioned a distance 53 of 6.74 inches above the plane of the drain connection 36. Nozzle 38 is located a distance 55 of 7.64 inches below the lower surface 54 as measured from the intersection of an asymptote 57 of the lower surface 54 and a projection 59 of the cylindrical wall 32 below the surface 54.

Referring now most particularly to FIGS. 2, 3*a*, 3*b*, 4*a* and 4*b*, tank 22 preferably has an enlarged portion or cavity 52 in its upper region defined by a sloping, non-horizontal lower surface or ramp-like extension 54, a pair of generally vertical side walls 56, 58, and a generally vertical and slightly angled stepped front wall or outer wall 60. The ramp-like extension projects laterally out from a portion of the cylindrical side wall 32 a distance 61 of 13.57 inches. Outer wall 60 preferably is oriented at an angle 63 of 10 degrees. The ramp-like extension preferably has an angle 33 of 30 degrees (plus or minus 3 degrees) with respect to horizontal. However, angle 33 may be selected to be within the range of 10 to 85 degrees. Furthermore, it is to be understood that the ramp-like extension may be curved in various ways, and desirably is shaped to minimize "dead spots" i.e., those regions which do not have as much flow as other regions of the mixing chamber. Extension side walls 56 and 58 are preferably spaced apart a distance close to or equal to the diameter 44 of tank 22 to provide an increased capacity for tank 22 while limiting the height and width of tank 22. As may be seen in FIG. 3*a*, walls 56 and 58 preferably taper slightly towards each other as they extend away from the cylindrical portion of the tank. The width of tank 22 is preferably less than or equal to 32 inches to enable passage of tank 22 through a standard width door. The height 100 is preferably 32.5 inches from an upper edge to the drain connection 36 to enable the tank to be mounted with its upper edge no higher than 48 inches above the adjacent floor to reduce the height necessary to lift containers of dry chemical when preparing a dialysis solution. Providing enlarged portion or cavity 52 enables tank 22 to have a capacity of 110 gallons with a reduced height over that which would be necessary with a conventional simple cylindrical tank. Tank 22 has a length 102 of 43.33 inches and a width of 28.5 inches (not including the upper rim). The angle 106 of the cone of the bottom surface is preferably 20 degrees. Tank 22 is preferably formed of high density polyethylene, but may be formed of other materials, as desired. The mixing tank apparatus 22 of the present invention is thus seen to include a mixing chamber 23 having a generally vertical sidewall 32 extending upward from the bottom wall 34. Sidewall 32 preferably circumscribes at least a portion of a cylinder to form a main well. The mixing chamber also has cavity 52 extending generally horizontally and projecting outward from the vertical sidewall 32. The mixing tank 22 also includes drain connection 36 located at a lowermost portion of the bottom wall, and further includes the fluid supply nozzle 38 projecting into the mixing chamber, with the nozzle 38 directed at least partially toward the cavity 52 so that fluid is drawn from the mixing chamber by the drain connection 36 and is returned to the mixing chamber by the fluid supply nozzle 38 and the combination of the drain connection and fluid nozzle create a first rotational pattern and a second rotational pattern in the fluid, with the first pattern having a generally vertically-oriented vortex and the second pattern having a horizontally-oriented vortex in the mixing chamber (as will be described in more detail infra) to accelerate dissolving of the dry chemicals.

Figure 3A:
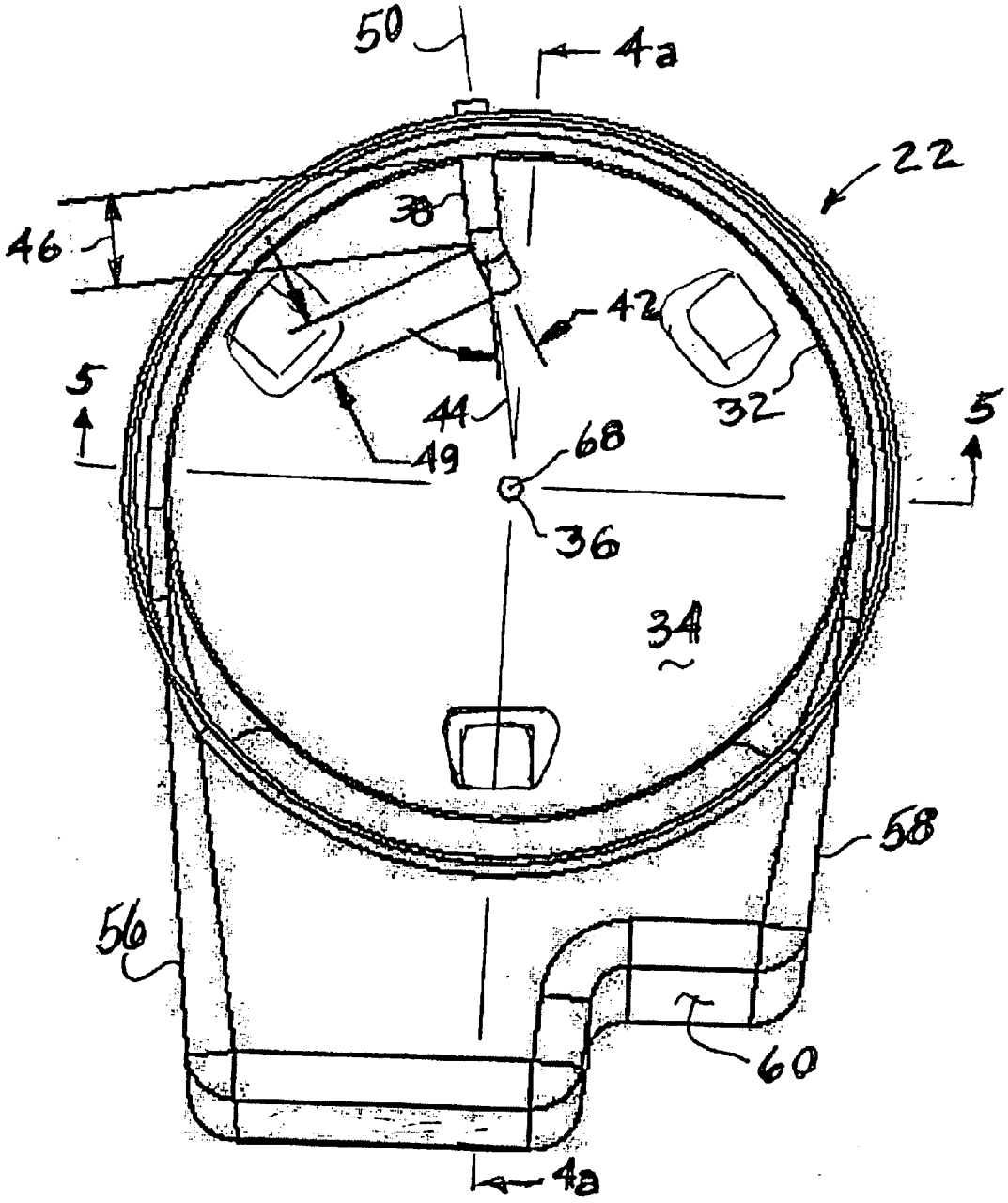
FIG. 3*a* is a plan view of the mixing tank of FIG. 2.
Figure 3B:
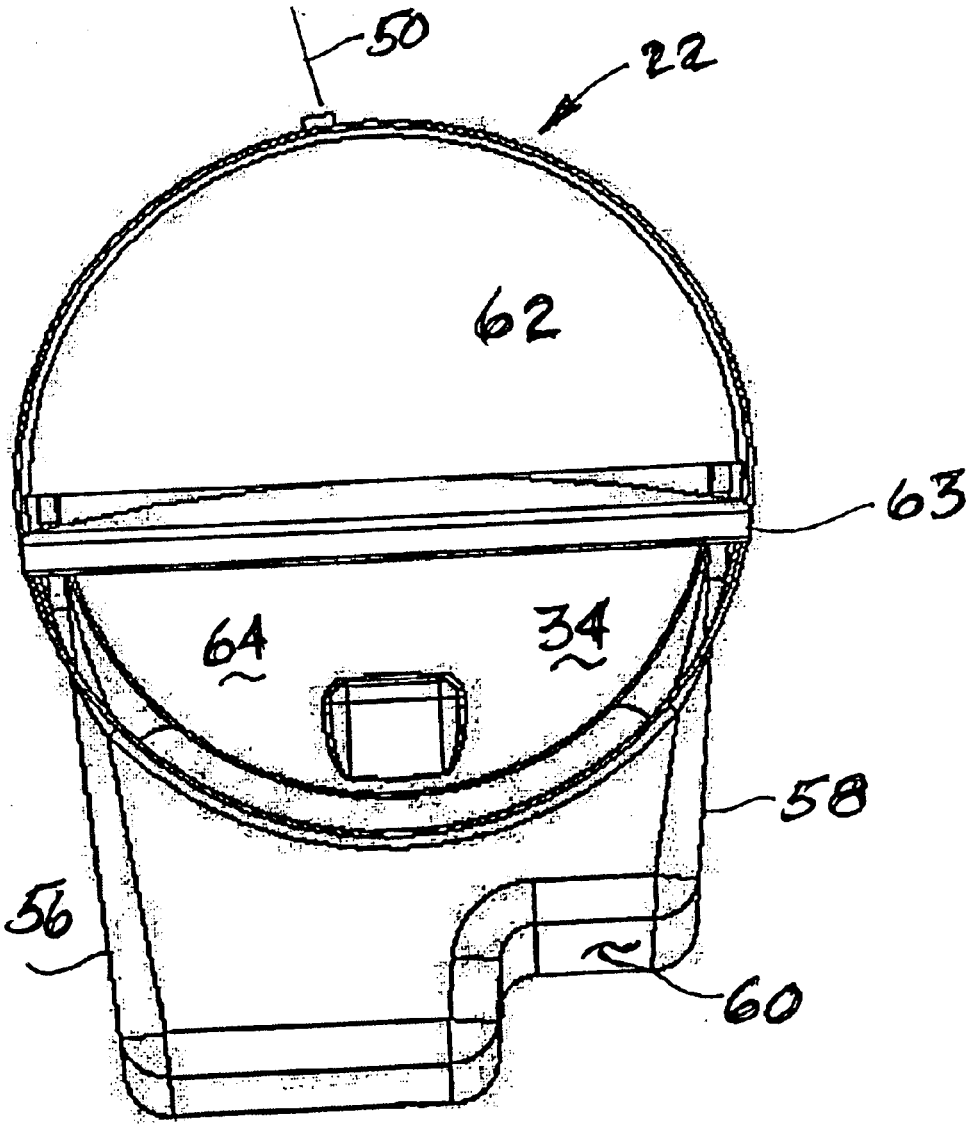
FIG. 3*b* is a plan view similar to that of FIG. 3*a*, except with a cover on the tank and with a lid of the cover in an open condition.
Figure 4A:
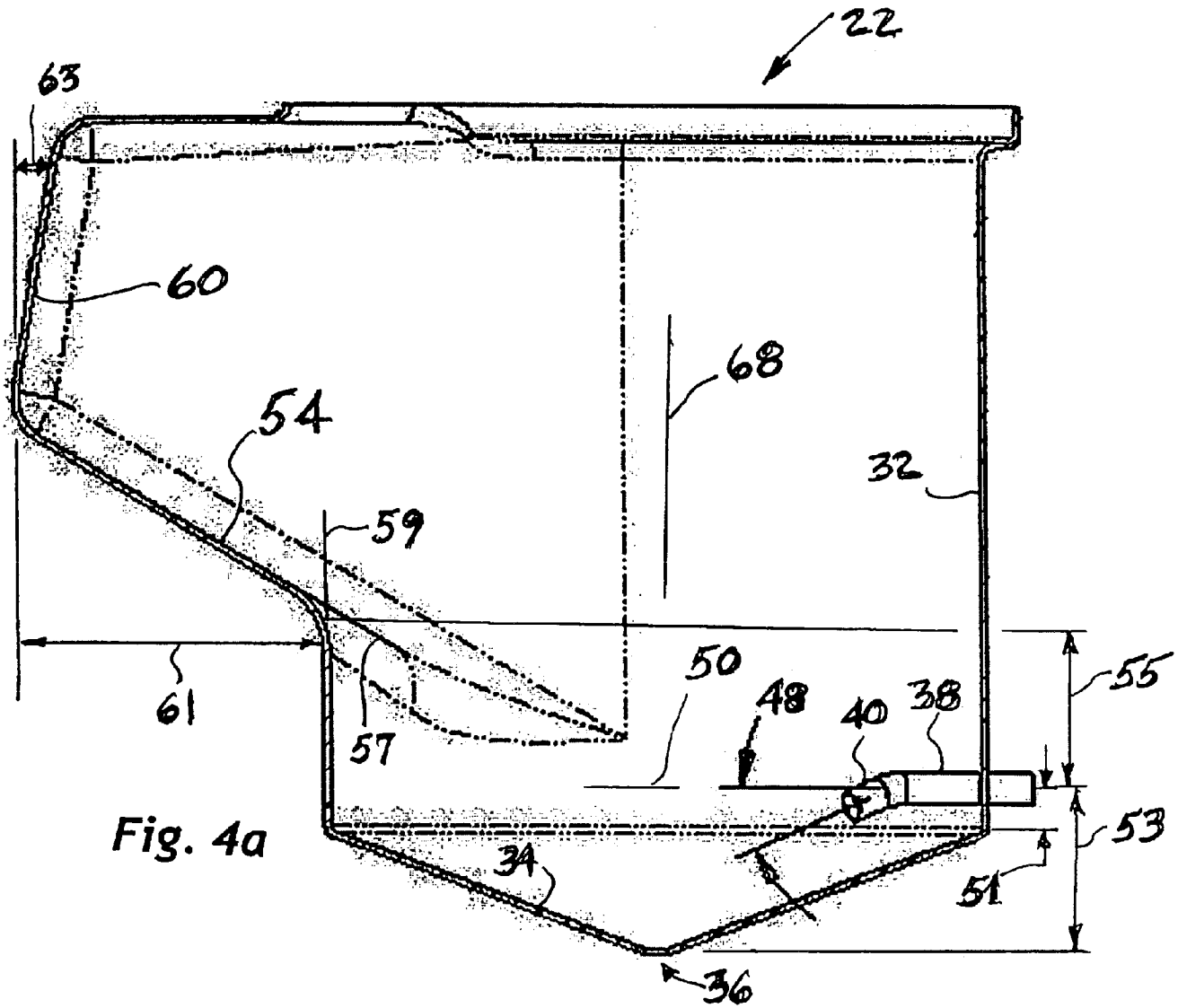
FIG. 4*a* is a first side section view along line 4*a*—4*a* of FIG. 3.
Figure 4B:
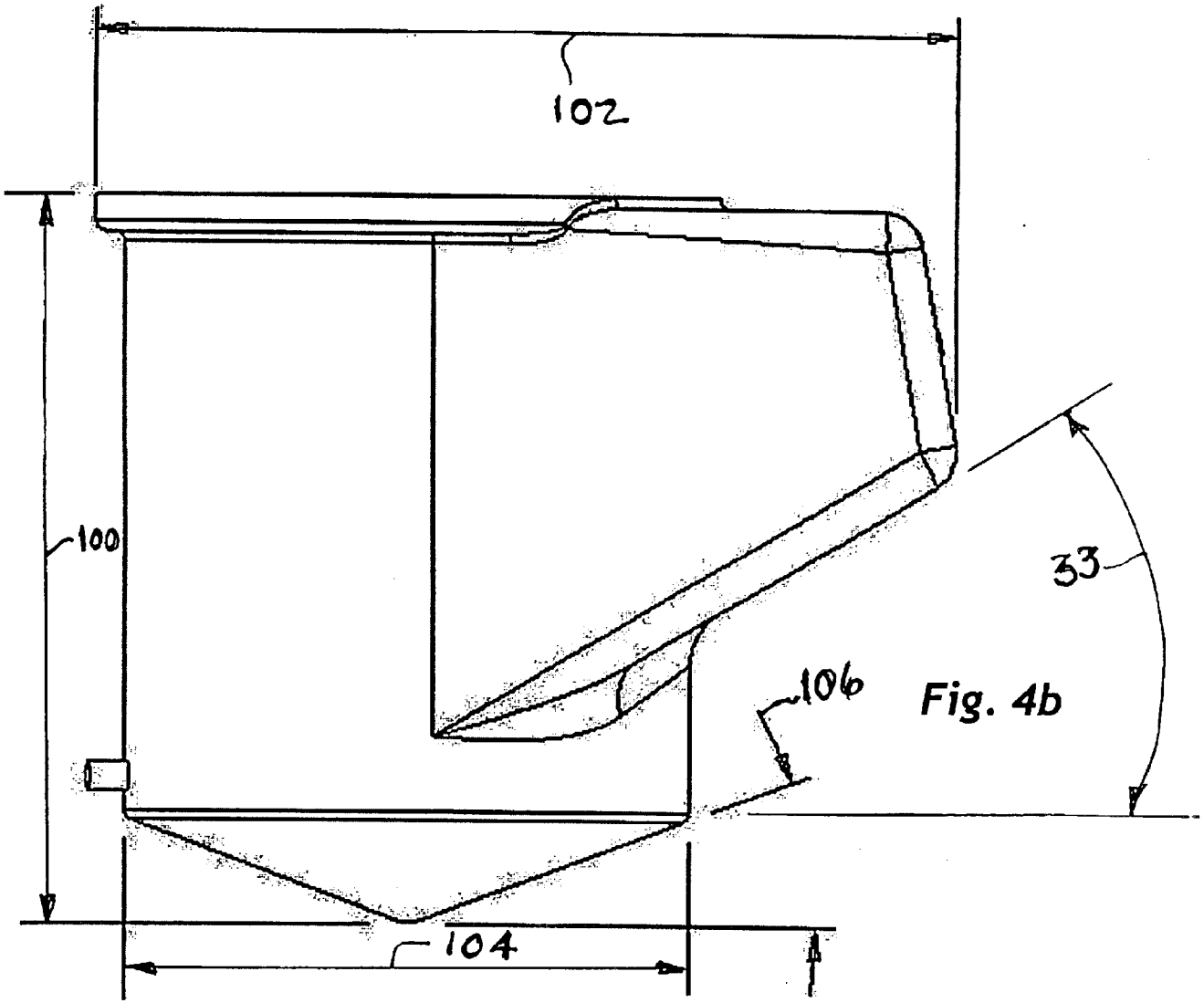
FIG. 4*b* is a side view corresponding to FIG. 4*a*.
Figure 5:
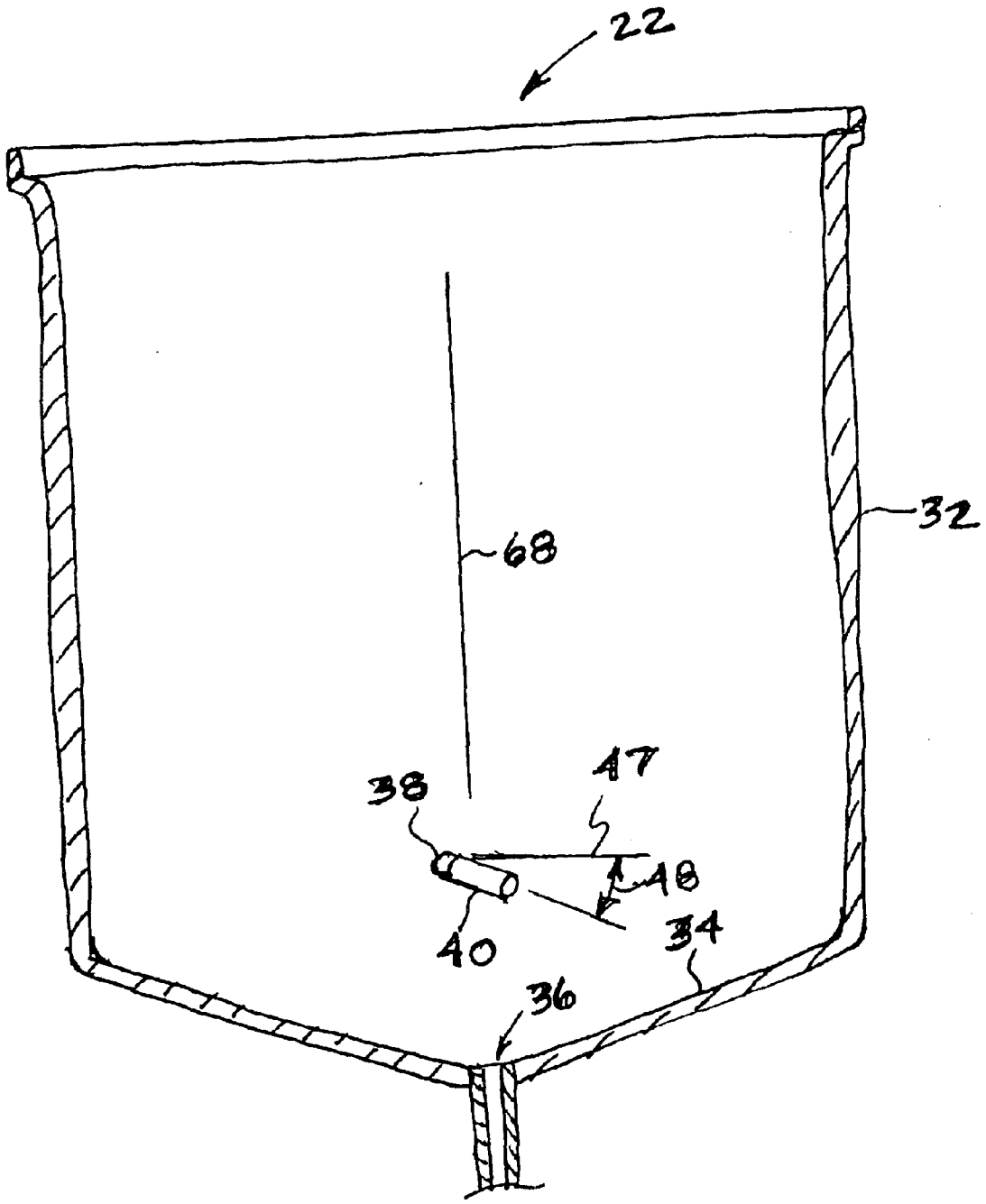
FIG. 5 is a second side section view along line 5—5 of FIG. 3*a*.

A cover 62, shown in FIG. 3*b*, has a "D" shaped lid 63 which provides a corresponding "D" shaped opening 64 for access to the mixing chamber 30 of tank 22 for adding dry chemicals. The lid 63 preferably remains closed over opening 64 in cover 62 when the dry chemicals are added using an eductor as described infra. The design of tank 22 provides a low vertical profile such that a person of average build will be able to more easily manually transfer the dry chemicals to the tank, by having a relatively low upper edge of the tank over which the dry chemicals must be lifted in the manual transfer operation, if that process is used. Preferably, the tank height is 36 inches, allowing the upper edge to be no greater than 48 inches above an adjacent surface such as a floor on which the person delivering the chemicals would stand while manually transferring the chemicals to the tank. In one embodiment, the low vertical profile is 35.5 inches from a top of the mixing tank to a lowermost portion of the bottom wall of the mixing tank.

The tank design of the present invention also provides improved mixing by creating rapid and turbulent liquid flow at the bottom of the tank to prevent settling of chemical solids. The mixing fluid (liquid and undissolved solids) collides with the irregular geometry of the tank surface to create turbulence that maintains the chemical particles in agitated suspension. In addition, as has been referred to, the irregular geometry of the tank also allows the accommodation of large volume preparations while maintaining waist high tank access to permit manual transfer of the solid chemicals to the tank.

Figure 6A:
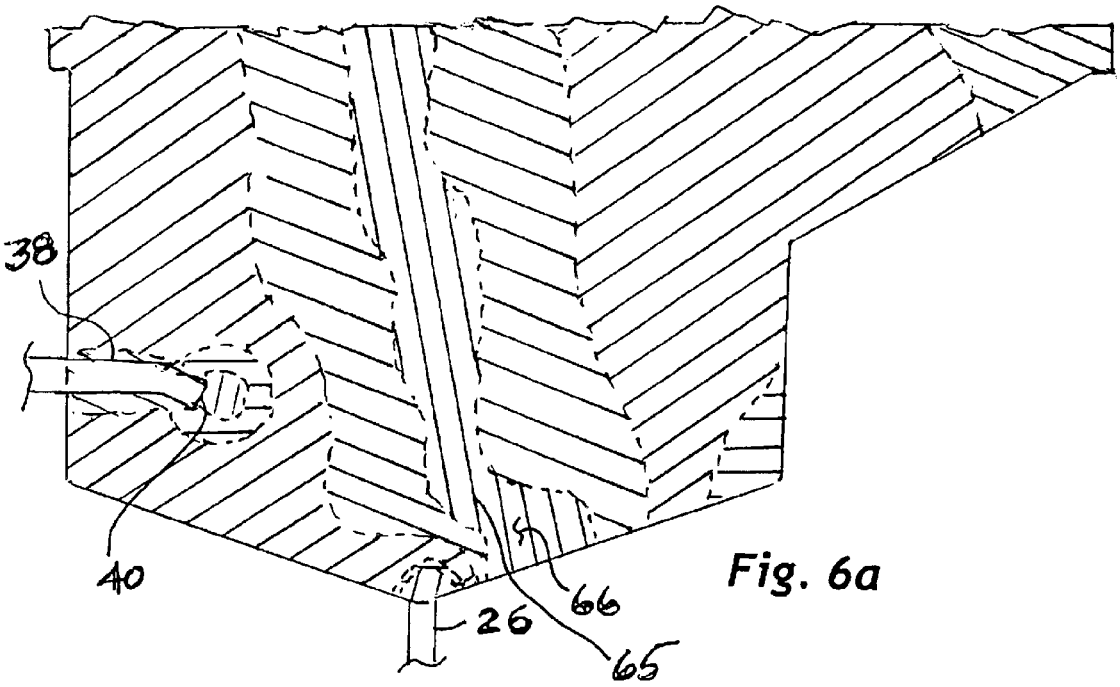
FIG. 6*a* is a fragmentary schematic representation of various flow rate ranges present in the lower portion of the mixing tank of the present invention.
Figure 6B:
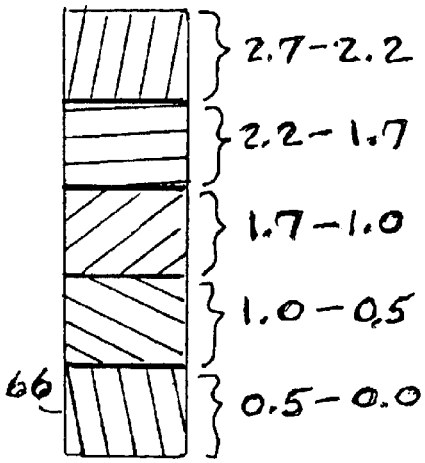
FIG. 6*b* is a key showing the hatching for the various flow rate ranges of FIG. 6*a*.

With a flow rate of 14 GPM or more through line 28, a computer model of the mixing taking place in the lower portion of tank 22 is illustrated in FIG. 6*a*, with a key to the flow rate hatching in FIG. 6*b* in units of feet/second. It is to be understood that FIG. 6*a* is a sectional view and that the hatched regions are generally toroidal in their three-dimensional shape. It is further to be noted that the transitions between hatched regions are not abrupt, but gradual, with the dashed boundary lines between hatched regions provided for simplicity of illustration. FIG. 6*a* illustrates a generally concentric family of mixing velocities at one point in time, with variations occurring over time. FIG. 6*a* shows a central axis of rotation 65 generally aligned concentrically within region 66 (for that moment in time), with region 66 being understood to be the region having the lowest flow rate. Most importantly, the central axis of rotation 65 is not concentric with the cylindrical sidewall 32 of the tank 22. It is to be further understood that while FIG. 6*a* shows the central axis 65 as linear, it is actually typically curvilinear, and has random fluctuations both in its curvature and location, analogous to a naturally occurring tornado or cyclone. Such fluctuations are desirable in that they add to the mixing effect of the present invention. With the arrangement of fluid supply nozzle 38 and directed flow from fluid outlet 40, the locus of the central axis of rotation 65 of the lowest flow region 66 is eccentrically positioned and angularly offset from a central axis 68 of the cylinder side wall 32. The improved results are due to the rapid flow rates at the bottom of the tank as well as the turbulence created as the circulating fluid collides with the irregular surfaces of the tank interior.

Figure 7A:
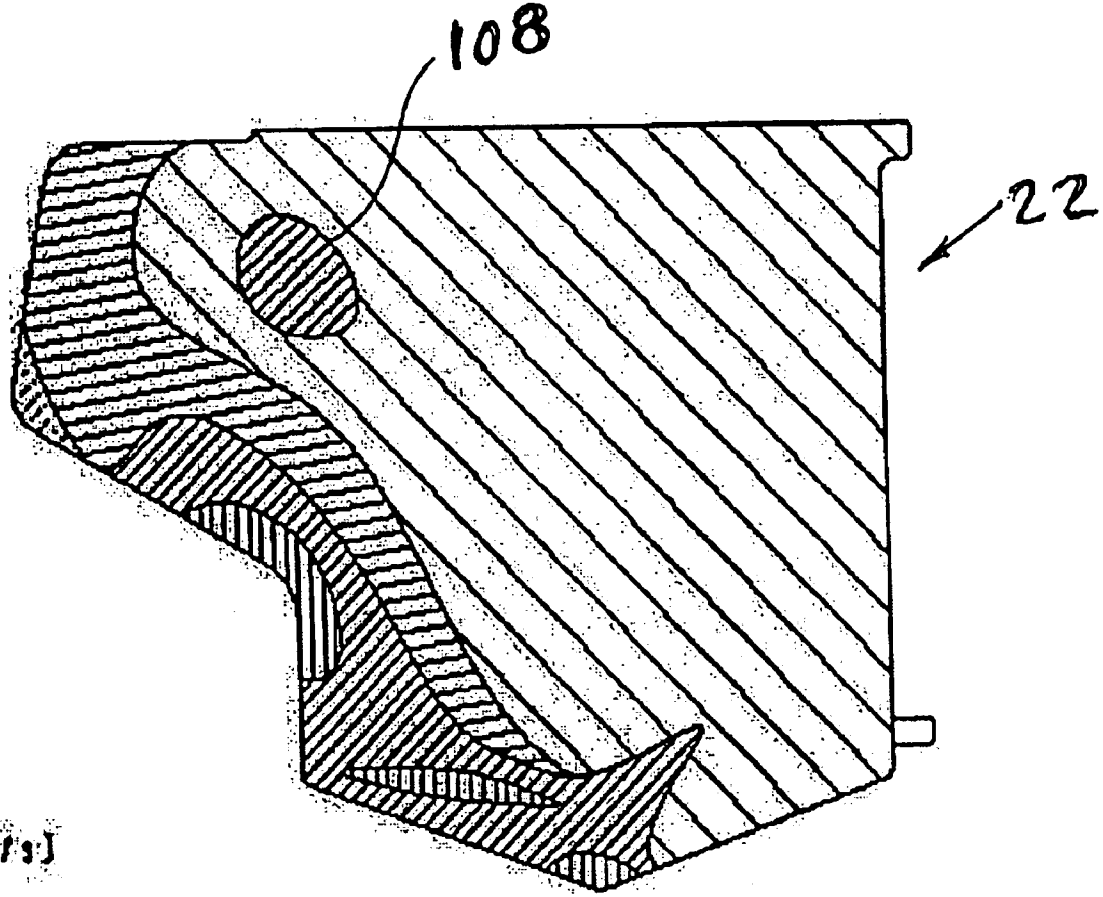
FIG. 7*a* is a schematic representation of various flow rate ranges present in the mixing tank of the present invention, particularly illustrating the flow rate ranges in the upper portion of the tank.
Figure 7B:
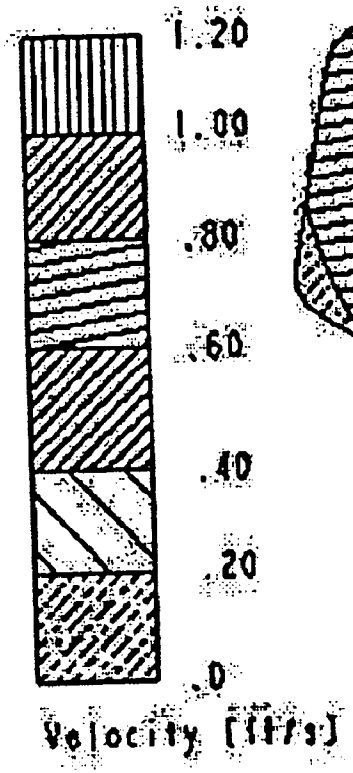
FIG. 7*b* is a key showing the hatching for the various flow rate ranges of FIG. 7*a*.
Figure 7C:
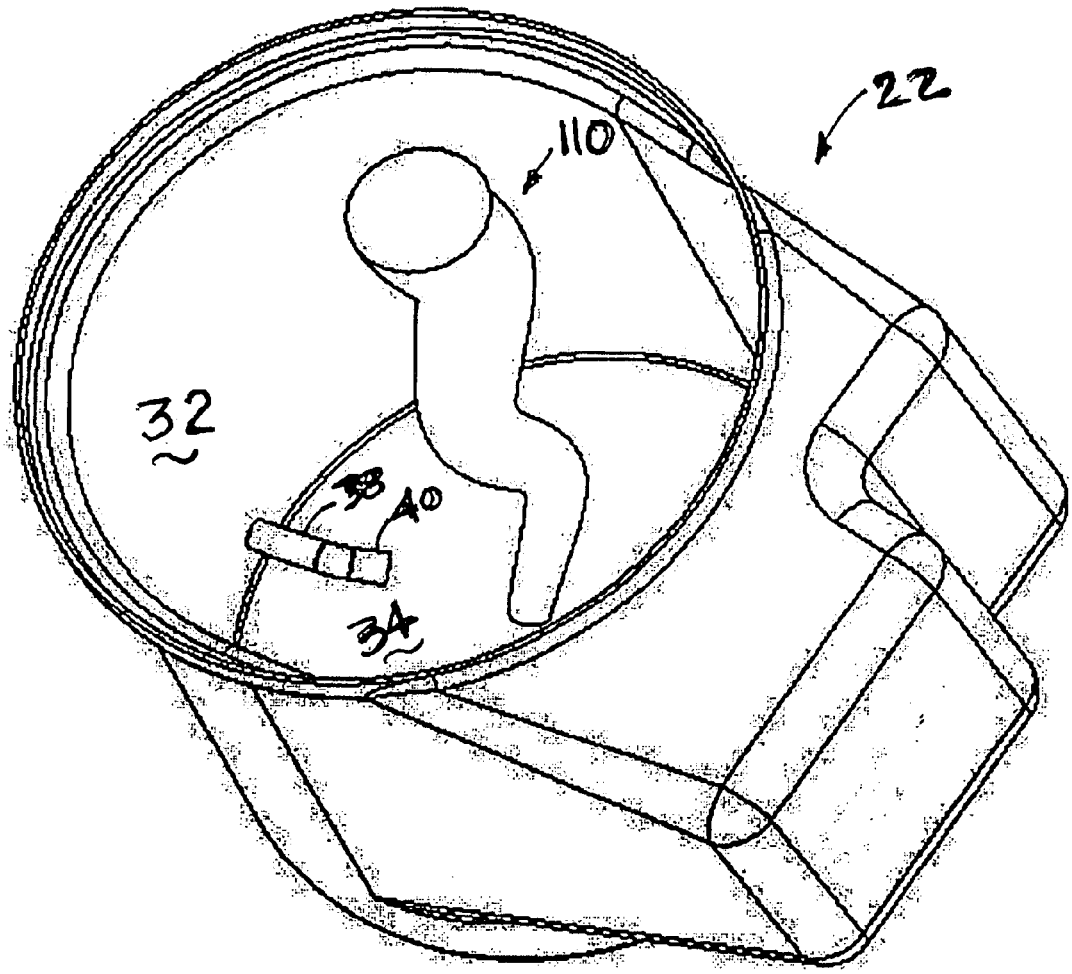
FIG. 7*c* is a perspective view from above showing a simplified view of a generally vertically oriented rotational flow pattern.
Figure 7D:
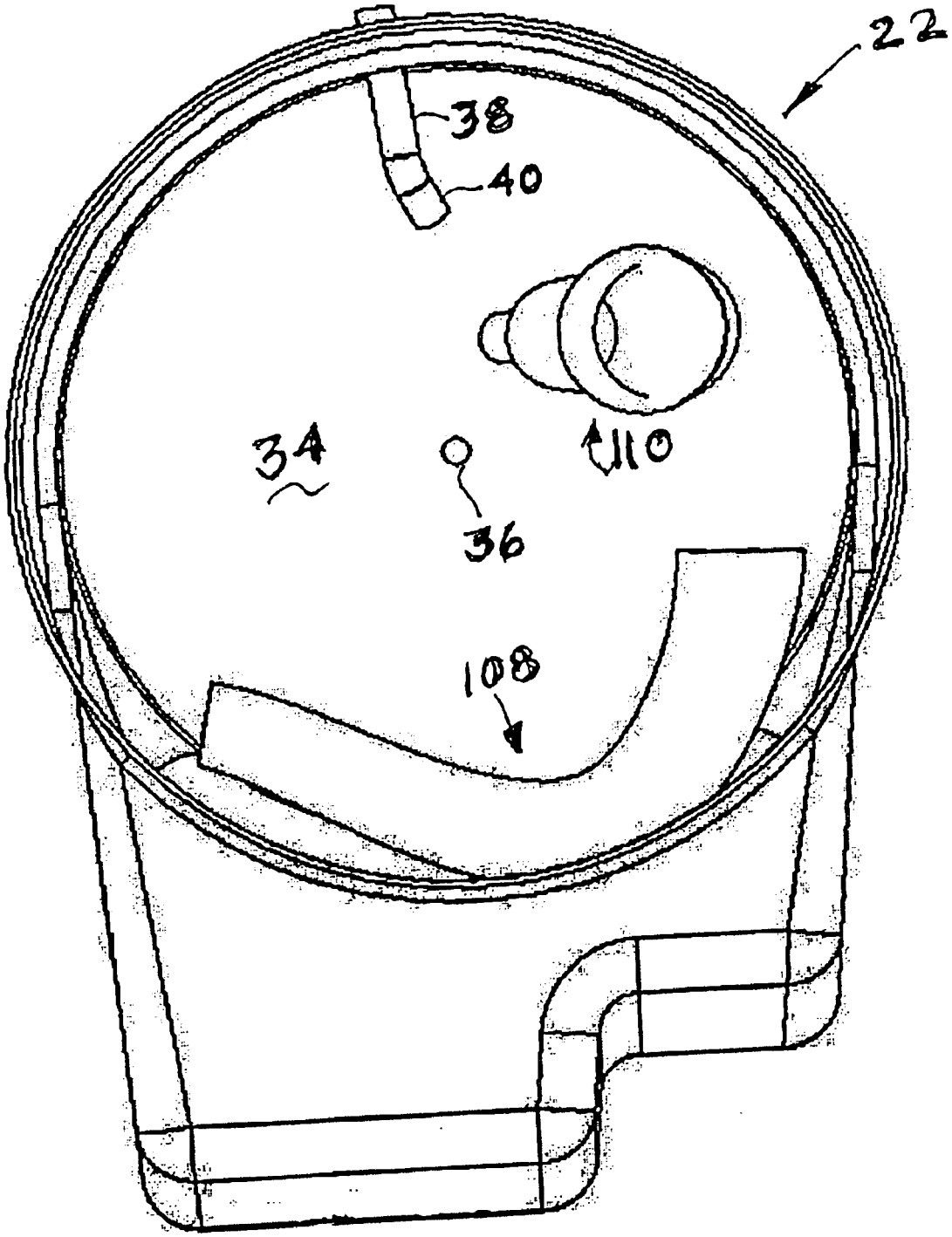
FIG. 7*d* is a top view showing the pattern of FIG. 7*c*, along with a generally horizontally oriented rotational flow pattern.
Figure 7E:
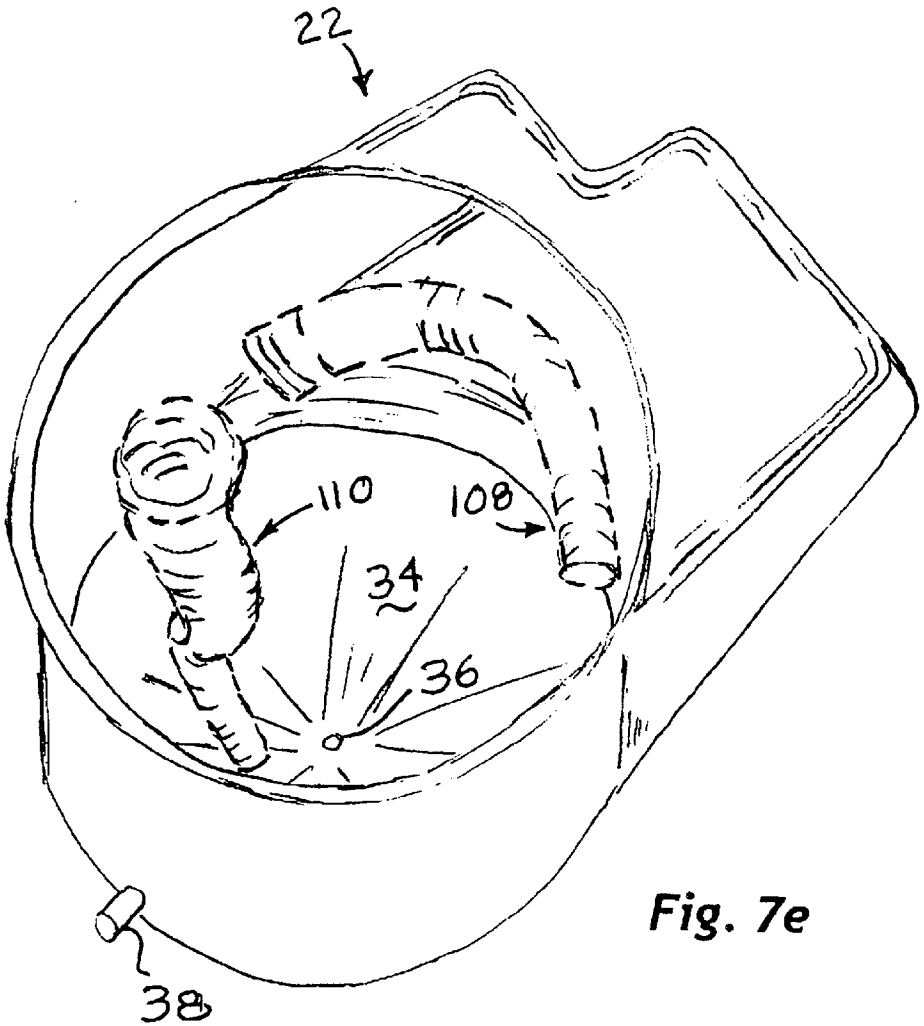
FIG. 7*e* is a view similar to that of FIG. 7*c*, except with the vertical and horizontal flow patterns shown as shaded solids using a computer modeling program to illustrate further features of the present invention.
Figure 7F:
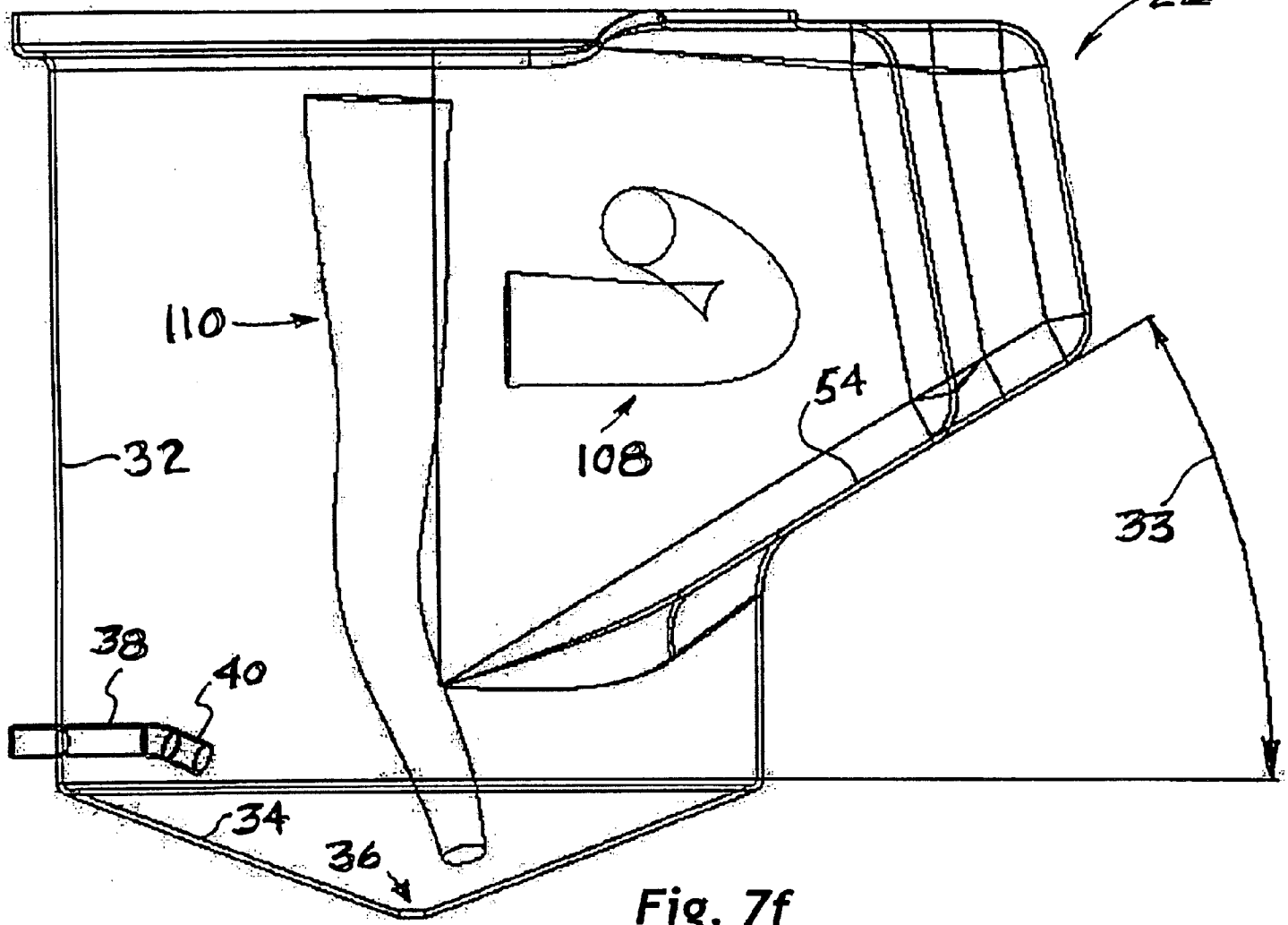
FIG. 7*f* is a view similar to that of FIG. 4*b*, except showing the vertical and horizontal flow patterns in a side elevation view.

In addition to the vertically oriented rotational flow pattern described above, the recirculation apparatus of the present invention also provides a horizontally oriented rotational flow pattern 108 in an upper portion of the tank 22 as shown in FIG. 7*a*. This sets up a collision of the returning fluid with the tank walls to create a turbulent state similar to that described for the vertical rotation. It is to be understood that the horizontally oriented mixing pattern has a generally L-shaped "central axis" with slight random "wave-like" or "snake-like" movement of both the shape and location of the "central axis" of the horizontal mixing pattern, all in an upper region of the tank. Although the mixing patterns are shown as discrete images in FIGS. 6*a*, 7*a*, 7*c*, 7*d*, 7*e* and 7*f*, it is to be understood that these illustrations are intended to convey the sense of the rotational mixing patterns which in reality are distributed and not discrete or discontinuous as shown. Furthermore, the images shown for the mixing patterns in these figures are representative for one point in time only, as the location, size and shape of the mixing patterns will vary over time in a random fashion. Nevertheless, the mixing patterns shown are believed to be representative of the principal characteristics of both the vertical mixing pattern 110 and the horizontal mixing pattern 108 of the tank 22 of the present invention. It is to be further understood that the mixing chamber of the tank of the present invention includes both the main well portion within the cylindrical sidewall, and the cavity projecting outward from the main well.

Figure 8:
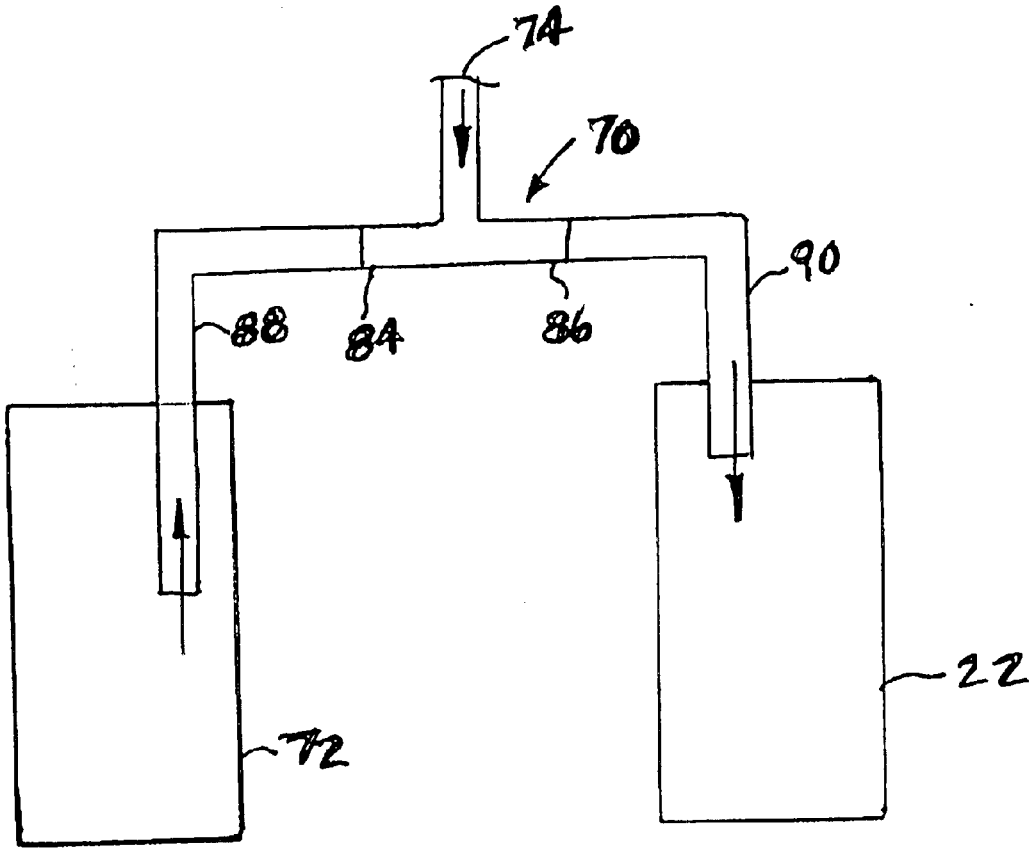
FIG. 8 is a simplified diagram showing an air aspirated dry chemical delivery system useful in the practice of the present invention.
Figure 9:
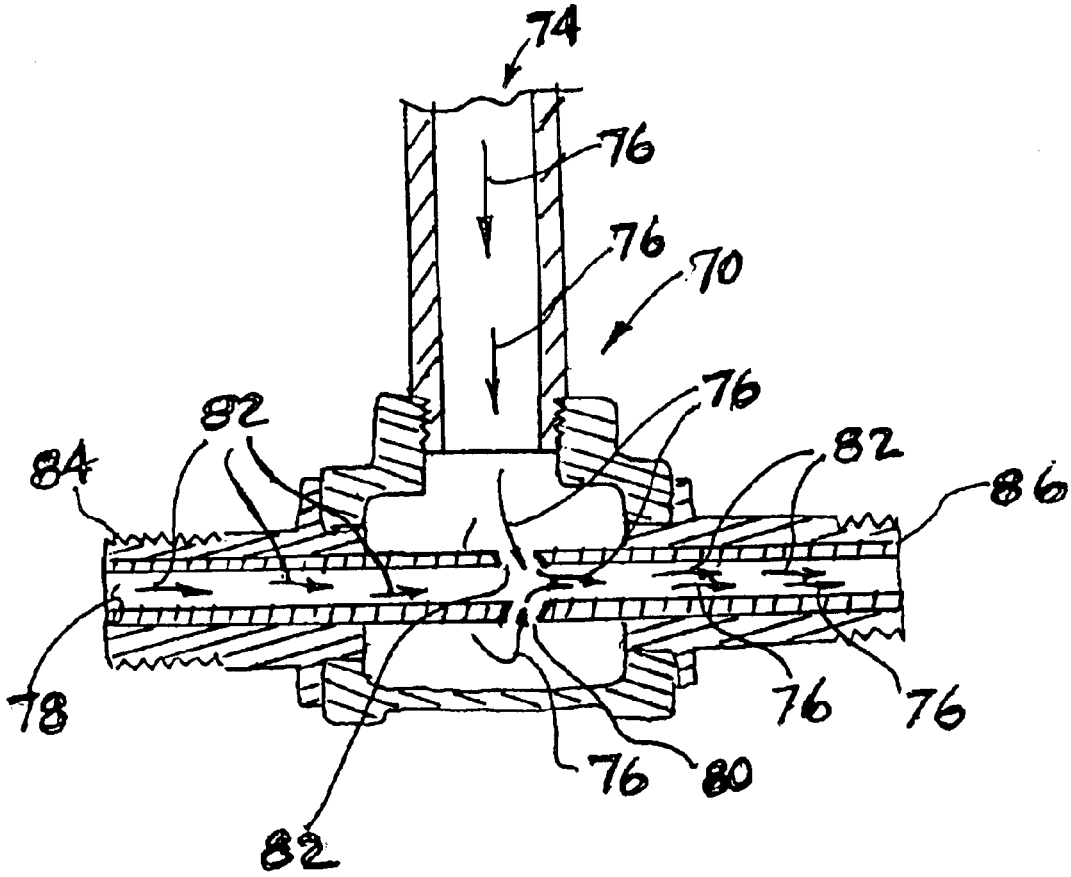
FIG. 9 is a detailed section view of a venturi eductor useful in the practice of the present invention.

Referring now to FIGS. 8 and 9, an alternative feed system for delivering the dry chemicals to the mixing tank may be seen. FIG. 8 is a simplified block diagram illustrating the use of a venturi eductor 70 to draw dry chemicals from container 72 and deliver the dry chemicals to the mixing tank 22. FIG. 9 is a section view of the venturi eductor 70. A fluid, which may be a gas such as compressed air, is delivered to inlet 74. Alternatively, the fluid may be a liquid, such as the water from mixing tank 22. The fluid, indicated by arrows 76 enters an inlet flow path 78 for the chemicals through a plurality of angled apertures 80. Eductor 70 creates a low pressure region at the material inlet 84, entraining the dry chemicals as either air borne or liquid borne particulates indicated by arrows 82, delivering the chemical particulate at material outlet 86. An inlet hose 88 is preferably connected to material inlet 84 to pick up the dry chemical from container 72, and a delivery hose 90 is connected to material outlet 86 to deliver the chemicals to mixing tank 22. It is to be understood that a certain amount of dissolution may take place in the eductor and delivery hose when a liquid propelled system is used, but that it is contemplated that the majority of mixing will take place in the mixing chamber of the mixing tank, because the particulate will not remain long in the eductor or delivery hose. As a still further alternative, it is to be understood that a jet pump (not shown) may be used in place of eductor 70.

In the practice of the present invention, it is possible to transfer the dry chemicals from shipping containers via a slurry transfer, as described, for example in U.S. Pat. Nos. 4,734,198 and 4,664,891, the entire contents of each of which are hereby incorporated by reference. In addition, manual transfer of the dry chemicals is also within the scope of the present invention, in which method the dry chemicals are manually released directly into the top of the mixing tank, after opening the lid 63 at the top of the tank 22.

Figure 10A:
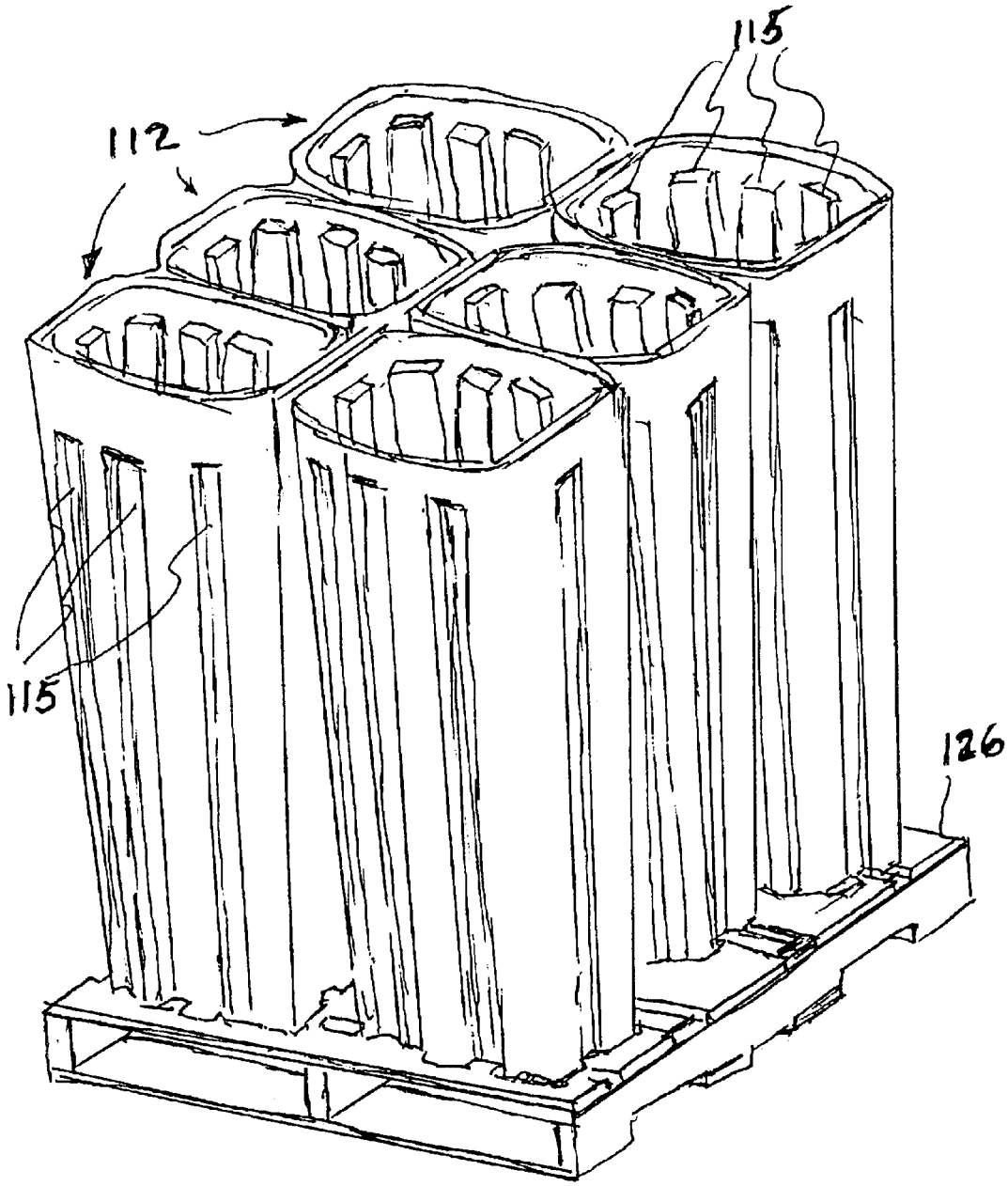
FIG. 10*a* is a perspective view of a group of containers located on a pallet for shipping dry chemicals for use in the practice of the present invention.
Figure 10B:
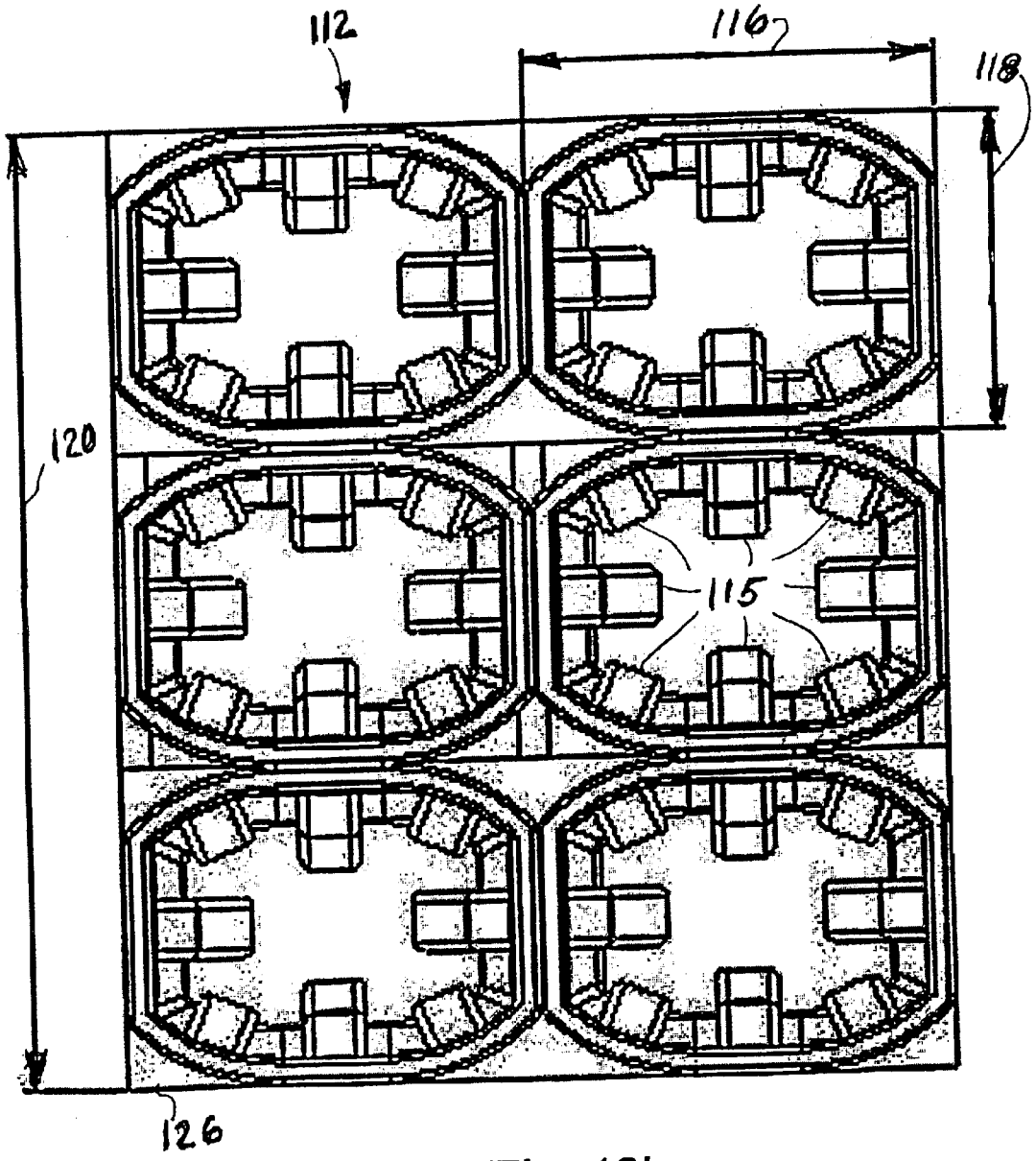
FIG. 10*b* is a top plan view of the containers and pallet of FIG. 10*a*.
Figure 10C:
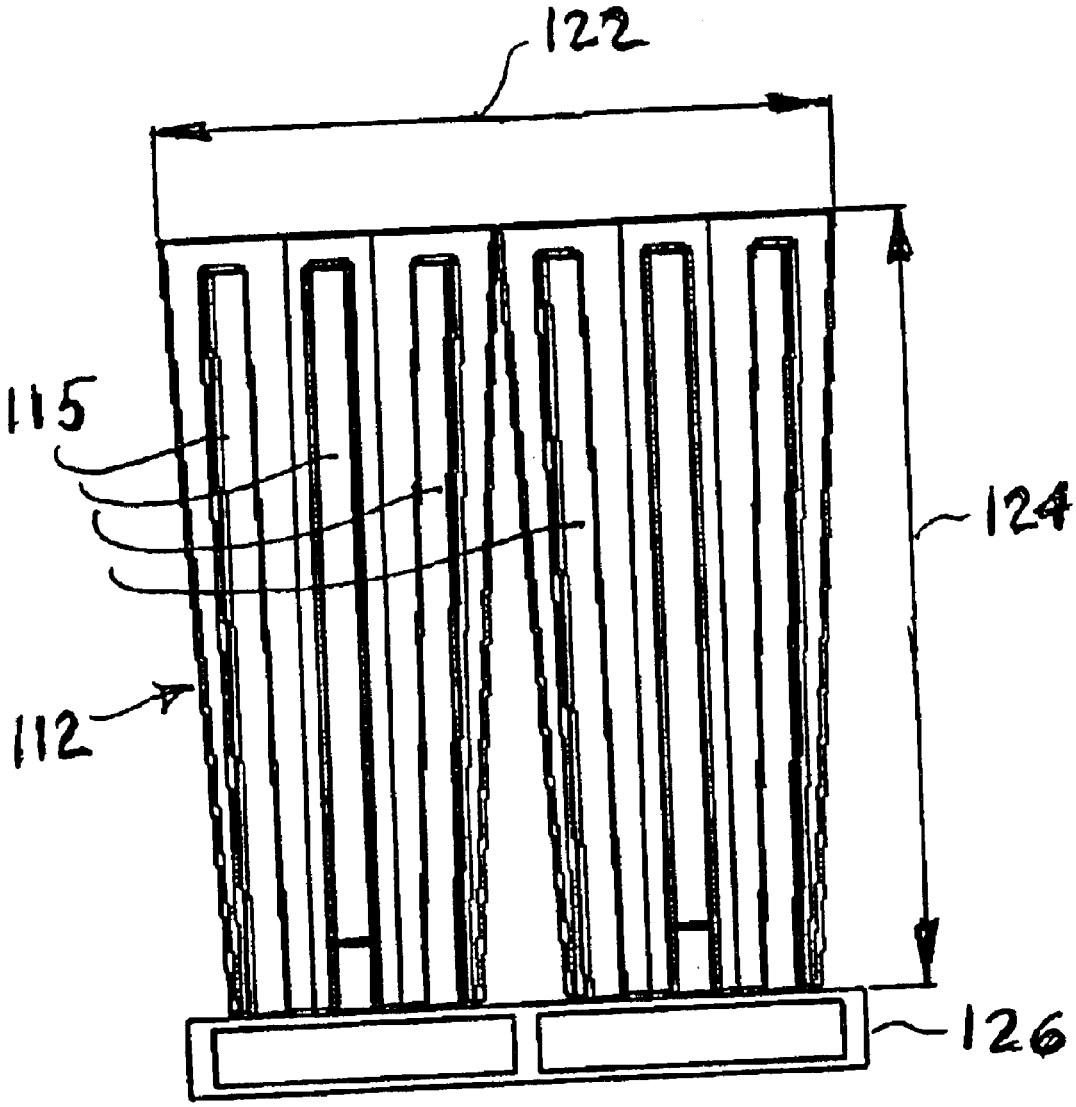
FIG. 10*c* is a side view of the containers and pallet of FIG. 10*a*.
Figure 10D:
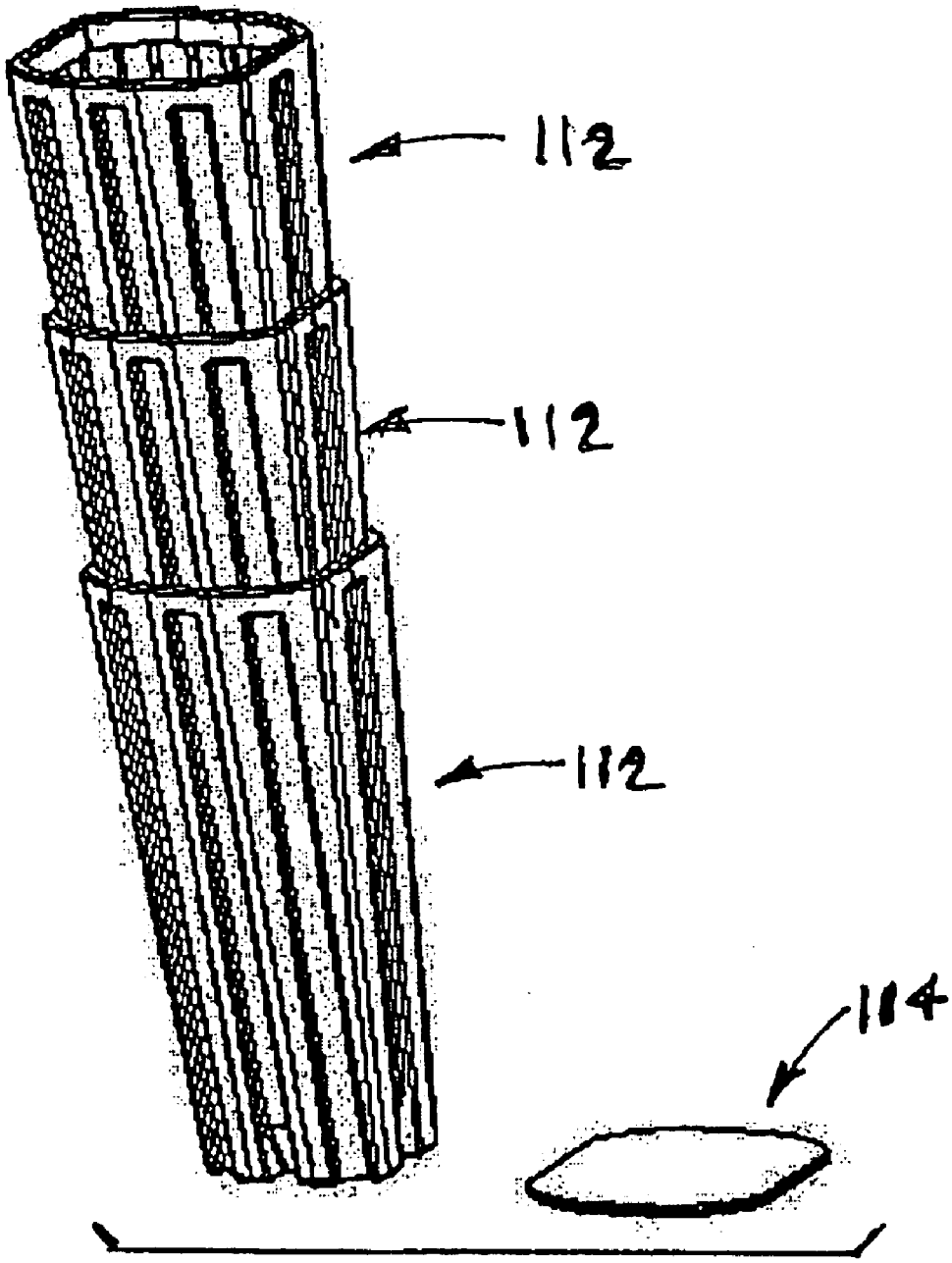
FIG. 10*d* is a view of three containers from FIG. 10*a* in a nested configuration and with a lid for one container.

Referring now to FIGS. 10*a*–10*d*, containers 112 for shipping the dry chemicals can be seen, along with a cover 114 for one container. The containers are preferably tapered to permit stacking (as shown in FIG. 10*d*) when empty, to facilitate return and reuse by the shipper. Each shipping container has a plurality of recessed panels 115 to provide stiffening for the container. Optionally, the dry chemicals may be carried within a polymer bag or liner (not shown) within an individual shipping container 112. As may be seen in FIGS. 10*b* and 10*c* each shipping container 112 has a maximum width 116 of 20 inches and a maximum length 118 of 16 inches such that an array of six containers 112 will have overall dimensions 122, 124 of 48 and 40 inches, respectively, with a height 124 of 48 inches, so as to fit on a conventional shipping pallet 126. Containers 112 are preferably formed of high density polyethylene but may be made of other materials, as desired.

Figure 11:
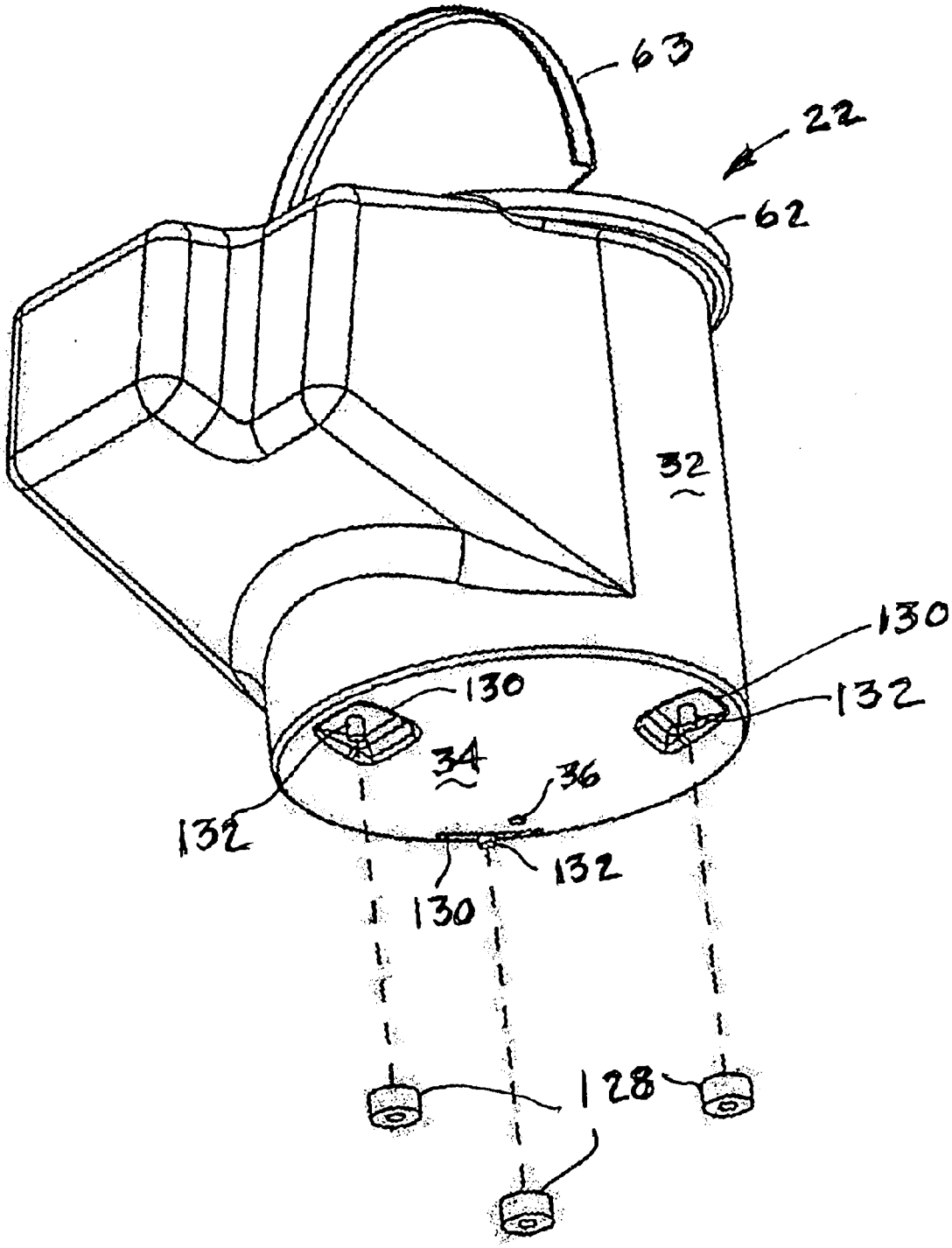
FIG. 11 is a perspective view from below showing an arrangement of load cells useful in the practice of the present invention.

In one aspect of the present invention, a single load cell or a plurality of load cells, as shown in FIG. 11 may be used to determine the weight of the water (initially) and (subsequently) the combined weight of chemicals and water in the mixing tank 22. FIG. 11 shows an exploded view of suitable for this purpose. Each load cell 128 is preferably mounted in a recess 130, engaging tank 22 via a stud 132.

This invention is not to be taken as limited to all of the details thereof as modifications and variations thereof may be made without departing from the spirit or scope of the invention.

What is claimed is:

1. A mixing tank apparatus for mixing dry chemicals with water to form a concentrated hemodialysis solution, comprising:

a. a mixing chamber having a generally vertical sidewall extending upward from a bottom wall and circumscribing at least a portion of a cylinder to form a main well, the mixing chamber also having a cavity extending generally horizontally and projecting outward from the vertical sidewall;

b. a drain connection located at a lowermost portion of the bottom wall; and c. a fluid supply nozzle projecting into the mixing chamber and directed at least partially toward the cavity wherein fluid is drawn from the mixing chamber by the drain connection and is returned to the mixing chamber by the fluid supply nozzle and the combination of the drain connection and fluid nozzle create a first rotational pattern and a second rotational pattern in the fluid, with the first pattern having a generally vertically-oriented vortex and the second pattern having a horizontally-oriented vortex in the mixing chamber to accelerate dissolving of the dry chemicals.

2. The apparatus of claim 1 wherein the cavity has a non-horizontal lower surface angled to direct any solids falling by gravity in the cavity to move out of the cavity and into the main well.

3. The apparatus of claim 2 wherein the lower surface of the cavity is tilted at an angle of about 30 degrees from the horizontal to direct solids to the main well.

4. The apparatus of claim 2 wherein the angle of the outer wall of the cavity is sloped to extend towards the main well as the wall rises from the lower surface of the cavity.

5. The apparatus of claim 1 wherein liquid flows from the drain connection and is returned to the mixing tank apparatus by the fluid supply nozzle at a flow rate of about 14 gallons per minute.

6. The apparatus of claim 1 wherein the cavity has an outer wall shaped to direct fluid impinging thereon back to the main well from the cavity.

7. The apparatus of claim 6 wherein the outer wall of the cavity is sloped at an angle with respect to vertical.

8. The apparatus of claim 7 wherein the angle of the outer wall of the cavity is about 10 degrees from vertical.

9. The apparatus of claim 1 wherein the bottom wall of the mixing chamber is sloped.

10. The apparatus of claim 1 wherein the bottom wall is conical.

11. The apparatus of claim 10 wherein the bottom wall has an angle of about 20 degrees with respect to horizontal.

12. The apparatus of claim 10 wherein the bottom wall has an angle of 20 degrees with respect to horizontal.

13. The apparatus of claim 10 wherein the drain connection is located at a vertex of the conical bottom wall.

14. The apparatus of claim 1 further comprising:

d. a dry chemical supply apparatus for delivering dry chemicals to the mixing tank, the supply apparatus including:

i. a dry chemical inlet arranged for drawing a dry chemical from a shipping container;

ii. a venturi eductor connected to the inlet for providing a low pressure in the inlet;

iii. an outlet connected to the venturi eductor for delivering fluid borne dry chemicals to the mixing tank.

15. The apparatus of claim 14 wherein the fluid comprises air and the venturi eductor includes a compressed air inlet for providing the low pressure in the dry chemical inlet and for providing propulsion for the air borne dry chemicals in the outlet.

16. The apparatus of claim 14 wherein the fluid comprises a liquid and the venturi eductor includes a drive fluid inlet for providing the low pressure in the dry chemical inlet and for providing propulsion for the liquid borne chemicals via the outlet to the mixing tank.

17. The apparatus of claim 1 further comprising d. at least one load cell positioned to support and weigh the tank and its contents.

18. The apparatus of claim 17 wherein the at least one load cell comprises a plurality of load cells.

19. The apparatus of claim 1 wherein an upper edge of the tank is located no higher than about 48 inches above an adjacent surface for a person to stand on to manually transfer dry chemicals to the mixing tank.

20. The apparatus of claim 1 wherein a height of the tank is about 36 inches from the drain connection to an upper edge of the tank.

21. The apparatus of claim 1 wherein the fluid outlet is directed at a horizontal angle of about 20 degrees with respect to the fluid supply nozzle.

22. The apparatus of claim 1 wherein the fluid outlet is directed at a horizontal angle of 20 degrees with respect to the fluid supply nozzle.

23. The apparatus of claim 1 wherein the fluid outlet is directed at a vertical angle of about 24 degrees with respect to the fluid supply nozzle.

24. The apparatus of claim 1 wherein the fluid outlet is directed at a vertical angle of 23.8 degrees with respect to the fluid supply nozzle.

25. The apparatus of claim 1 further comprising d. a shipping container for dry chemicals having a plurality of recessed panels for rigidity.

26. The apparatus of claim 25 wherein the shipping container further comprises sidewalls tapered to permit nesting of empty containers.

27. The apparatus of claim 1 wherein the mixing chamber further comprises a cylindrical portion and the cavity further comprises a generally rectangular portion increasing an internal volume of the mixing tank while maintaining a low vertical profile to reduce the effort required to lift dry chemicals for a manual transfer of the dry chemicals to the mixing tank over an upper edge of the mixing tank.

28. The apparatus of claim 27 wherein the low vertical profile is about 36 inches from a top of the mixing tank to a lowermost portion of the bottom wall of the mixing tank.

29. The apparatus of claim 27 wherein the low vertical profile is 35.5 inches from a top of the mixing tank to a lowermost portion of the bottom wall of the mixing tank.

30. A mixing tank apparatus for mixing dry chemicals with water to form a concentrated hemodialysis solution, comprising:

a. a mixing chamber having a cylinder sidewall extending up from a bottom wall and a cavity having a lower surface forming a ramp-like extension projecting laterally out from a portion of the cylindrical sidewall;

b. a drain connection located at a lowermost portion of the bottom wall; and c. a fluid supply nozzle projecting into the cylinder sidewall and having a fluid outlet directed at a horizontal angle away from a diameter of the cylinder sidewall and further directed at a vertical angle downward from a horizontal direction wherein fluid is drawn from the tank by the drain connection and is returned to the tank by the fluid supply nozzle creating a rapid flow of the fluid having an axis of rotation eccentric to the cylinder sidewall and angled from vertical.

31. The apparatus of claim 30 wherein the mixing chamber is upright.

32. The apparatus of clam 30 wherein the cylinder sidewall is a circular cylinder.

33. The apparatus of claim 30 wherein the cylinder sidewall is a right circular cylinder.

34. The apparatus of claim 30 wherein the ramp-like extension is positioned at an angle of about 30 degrees with respect to horizontal.

35. The apparatus of claim 30 wherein the ramp-like extension is positioned at an angle of 30 degrees with respect to horizontal.

36. The apparatus of claim 30 wherein the outlet of the fluid supply nozzle is directed generally towards the ramp-like extension.

37. The apparatus of claim 30 wherein the bottom wall of the mixing chamber is conical.

38. The apparatus of claim 37 wherein the bottom wall has an angle of about 20 degrees with respect to horizontal.

39. The apparatus of claim 37 wherein the bottom wall has an angle of 20 degrees with respect to horizontal.

40. The apparatus of claim 37 wherein the drain connection is located at a vertex of the bottom wall.

* * * * *

UNITED STATES PATENT AND TRADEMARK OFFICE

CERTIFICATE OF CORRECTION

PATENT NO. : 6,830,367 B2
DATED : December 14, 2004
INVENTOR(S) : Peterson et al.

It is certified that error appears in the above-identified patent and that said Letters Patent is hereby corrected as shown below:

Column 2,
Line 53, delete "System 20" and substitute -- System 10 -- therefor.

Signed and Sealed this

First Day of November, 2005

JON W. DUDAS
*Director of the United States Patent and Trademark Office*